US007020965B2

(12) United States Patent
Bao

(10) Patent No.: US 7,020,965 B2
(45) Date of Patent: Apr. 4, 2006

(54) SHAVING DEVICE

(76) Inventor: Chengcong Bao, Nl. 568, Jiu Xin Highway, Jiu Ting Town, Songjiang, Shanghai 201615 (CN)

( * ) Notice: Subject to any disclaimer, the term of this patent is extended or adjusted under 35 U.S.C. 154(b) by 1 day.

(21) Appl. No.: 10/869,123

(22) Filed: Jun. 15, 2004

(65) Prior Publication Data

US 2004/0255466 A1 Dec. 23, 2004

(51) Int. Cl.
*B26B 19/14* (2006.01)

(52) U.S. Cl. ..... 30/43.6; 30/43.5

(58) Field of Classification Search ..... 30/43.4, 30/43.5, 43.6, 264, 265, 346.51
See application file for complete search history.

(56) References Cited

U.S. PATENT DOCUMENTS 4,038,747 A * 8/1977 Upton ..... 30/34.2
4,089,110 A * 5/1978 Rasco ..... 30/41.5
4,910,869 A * 3/1990 Labrijn ..... 30/43.6
5,007,168 A * 4/1991 Messinger et al. ..... 30/43
5,983,501 A * 11/1999 Izumi ..... 30/43.5
6,212,776 B1 * 4/2001 Izumi et al. ..... 30/43.4
6,553,668 B1 * 4/2003 Steinberg ..... 30/43.5
2004/0237308 A1 * 12/2004 Mitchell et al. ..... 30/43.6

* cited by examiner

*Primary Examiner*—Hwei-Siu Payer
(74) *Attorney, Agent, or Firm*—Raymond Y. Chan; David & Raymond

(57) ABSTRACT

An electric shaving device is disclosed comprising a shaving assembly which comprises at least a first shaving blade and at least a second shaving blade at a position parallel to said first shaving blade; and a gear arrangement comprising a motor gear, a first gear supported underneath the first shaving blade to rotatably engage with said motor gear, a driving gear coaxially mounted to the first gear, and a second gear supported underneath the second shaving blade to rotatably engage with the driving gear, wherein when the motor gear is driven to rotate, the first and second gears are driven to rotate in opposite direction, such that the first and second shaving blades are synchronically rotated in a bidirectional manner for improving the shaving efficiency.

20 Claims, 4 Drawing Sheets

SHAVING DEVICE

BACKGROUND OF THE PRESENT INVENTION

1. Field of Invention

The present invention relates to an electrical shaving device, more particularly, relates to a reversing electric shaver which comprises bidirectional rotary shaving blades for improving the shaving efficiency.

2. Description of Related Arts

Commonly, an electric shaver comprises a single shaving unit. It is seen that electric shavers equipped with double shaving units even triple shaving units have been available nowadays for improving the shaving efficiency. However, all shaving units of aforementioned electric shavers are inclusively rotated in a unidirectional way. A beard is the hair that grows on a man's chin, cheeks, and the area above the upper lip. Therefore, beard from different parts of face will have varied growing orientation. When the beard is oriented with a same direction of the rotary shaving units of the electric shaver, it is almost impossible that beard to be cut by the shaving units. As a result, the user has to shave repetitively from different directions to achieve a desirable shaving effect.

SUMMARY OF THE PRESENT INVENTION

A main object of the present invention is to provide an electric shaving device, which comprises bidirectional shaving units for providing an efficient shaving effect.

Accordingly, to achieve this object, the present invention provides an electric shaving device, comprising:

a shaving body having a shaving head;

a power supply received in the shaving body;

a motor supported in the shaving body to electrically connect with the power supply, wherein the motor has a motor shaft rotatably extended at the shaving head;

a shaving assembly comprising at least a first shaving blade rotatably supported at the shaving head, at least a second shaving blade rotatably supported at the shaving head at a position spaced apart from the first shaving blade; and a gear arrangement comprising a motor gear mounted at the motor shaft, a first gear supported underneath the first shaving blade to engage with the motor gear, a driving gear coaxially mounted to the first gear, and a second gear supported underneath the second shaving blade to engage with the driving gear, wherein when the motor gear is driven to rotate via the motor through the motor shaft, the first and second gears are driven to rotate in opposite direction, such that said first and second shaving blades are synchronically rotated in a bidirectional manner.

These and other objectives, features, and advantages of the present invention will become apparent from the following detailed description, the accompanying drawings, and the appended claims.

DETAILED DESCRIPTION OF THE PREFERRED EMBODIMENT

Figure 1:
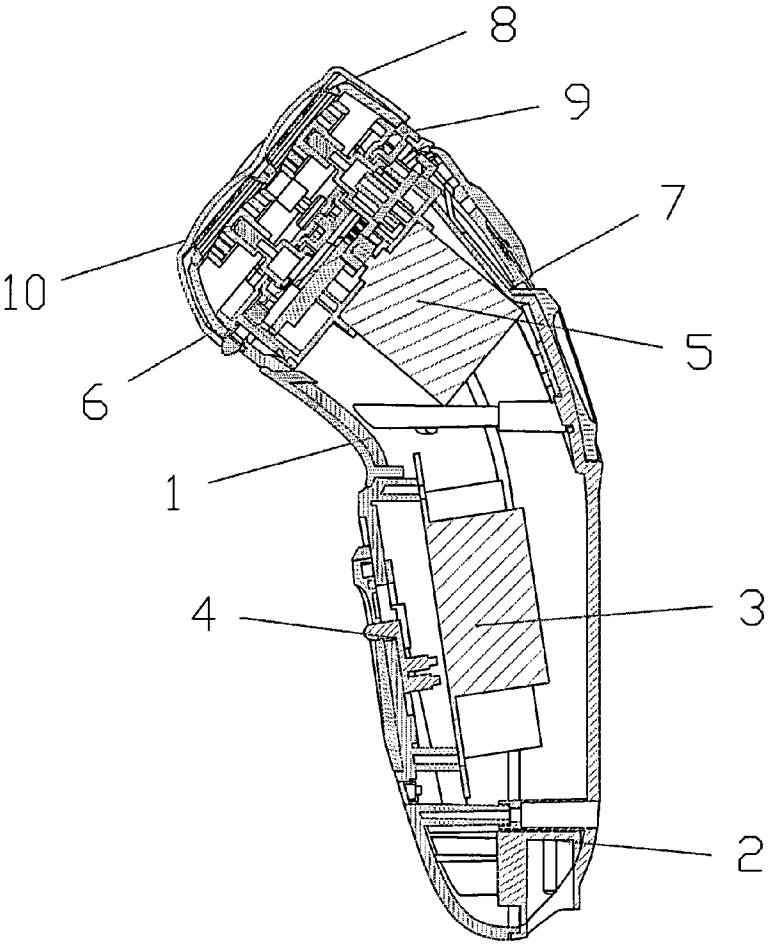
FIG. 1 is a sectional side view of the electric shaving device according to the first preferred embodiment of the present invention.
Figure 2:
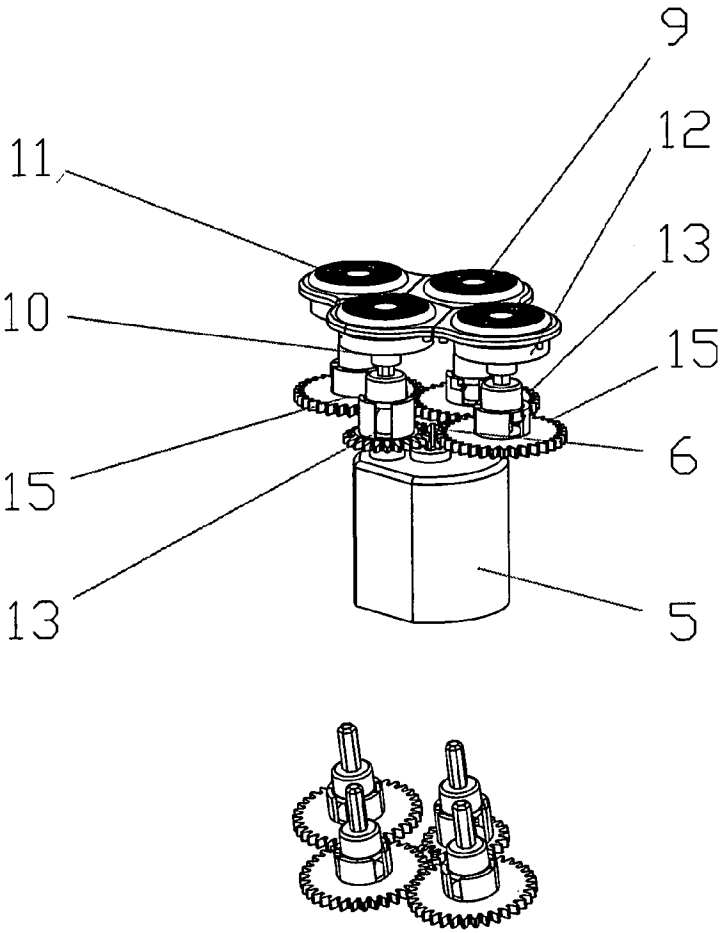
FIG. 2 is a partial perspective view of the electric shaving device according to the above preferred embodiment of the present invention illustrating the shaving assembly.
Figure 3:
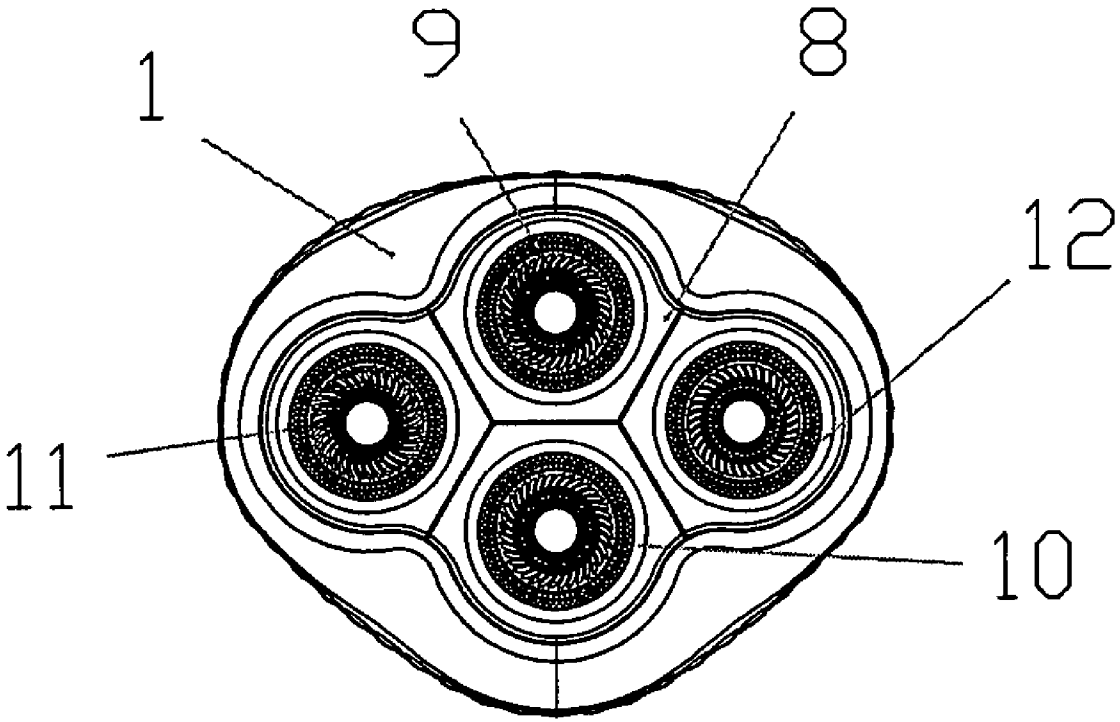
FIG. 3 is a top view of the shaving assembly the electric shaving device according to the first preferred embodiment of the present invention.

Referring to FIG. 1 to FIG. 4, the electric shaving device according to the first preferred invention is illustrated. The shaving device comprises an outer casing 1, a power source socket 2, a storage battery 3, a switch 4, an electric motor 5, a motor gear 6, an outer trimmer 7, a blade guider 8, wherein the improvement of the present invention comprises four shaving blades 9, 10, 11, 12 laterally disposed underneath the blade guider 8 in an edge to edge manner, and a gear assembly for driving four shaving blades 9, 10, 11, 12 to rotate, wherein the shaving blades 9 and 10 are positioned in a diagonal manner, and the other two shaving blades 11 and 12 are positioned in a diagonal manner.

The gear assembly comprises a pair of first gears 13 supported underneath the shaving blade 9, 10 and rotatably engaged with the motor gear 6 driven by the electric motor 5 for synchronically driving the shaving blades 9 and 10, a driving gear 14 coaxilly mounted to one of the first gears 13 in a lower position, and a pair of second gears 15 supported underneath the shaving blades 11, 12 to rotatably engage with the driving gear 14 for synchronically driving the shaving blades 11 and 12.

Therefore, if a user turned on the switch 4, the motor gear 6 would be driven by the electric motor 5. Since the motor gear 6 is disposed in a middle position between the diagonal pair of first gears 13 supported underneath the shaving blades 9 and 10, and is rotatably engaged with two first gears 13, the anticlockwise rotated main gear 6 would drive two first gears 13 as well as the shaving blades 9 and 10 into rotation in a clockwise direction. Furthermore, the driving gear 14 supported underneath the shaving blade 10 would be synchronically driven into rotation as well by.

Figure 4:
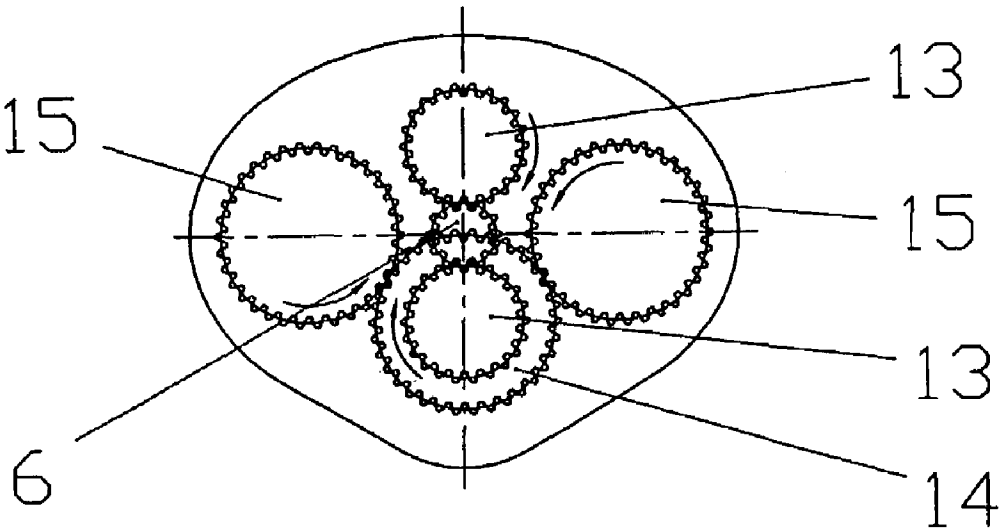
FIG. 4 is a schematic view of the gear arrangement of the electric shaving device according to the first preferred embodiment of the present invention.

Because the diagonal pair of second gears 15 are both rotatably engaged with the driving gear 14, the clockwise rotated driving gear 14 would drive two second gears 15 into rotation in an anticlockwise direction, which finally would synchronically drive the shaving blades 11 and 12 into rotation in an anticlockwise direction as shown in FIG. 4.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. An electric shaving device, comprising:

a shaving body having a shaving head;

a power supply received in said shaving body;

a motor supported in said shaving body to electrically connect with said power supply, wherein said motor has a motor shaft rotatably extended at said shaving head;

a shaving assembly comprising at least a first shaving blade rotatably supported at said shaving head and at least a second shaving blade rotatably supported at said shaving head at a position parallel to said first shaving blade; and a gear arrangement comprising a motor gear coaxially mounted at said motor shaft, a first gear supported underneath said first shaving blade to rotatably engage with said motor gear, a driving gear coaxially mounted to said first gear, and a second gear supported underneath said second shaving blade to rotatably engage with said driving gear, wherein when said motor gear is driven to rotate via said motor through said motor shaft, said first and second gears are driven to rotate in opposite direction, such that said first and second shaving blades are synchronically rotated in a bidirectional manner.

2. The electric shaving device, as recited in claim 1, wherein said shaving assembly further comprises an additional first shaving blade and an additional second shaving blade, wherein said two first shaving blades and said two second shaving blades are positioned at said shaving head in a diagonal manner, wherein said gear arrangement further comprises an additional first gear supported underneath said additional first shaving blade to rotatably engage with said motor gear and an additional second gear supported underneath said additional second shaving blade to rotatably engage with said driving gear, wherein when said motor gear is rotated, said two first gears and said second gears are driven to rotate in opposite direction such that said first shaving blades are synchronically rotated in one direction while said second shaving blades are synchronically in an opposed direction.

3. The electric shaving device, as recited in claim 1, wherein said first and second shaving blades are positioned at said shaving head at a same planar direction.

4. The electric shaving device, as recited in claim 1, wherein a diameter of said second gear is larger than a diameter of said first gear.

5. The electric shaving device, as recited in claim 2, wherein a diameter of each said second gear is larger than a diameter of said each first gear.

6. The electric shaving device, as recited in claim 3, wherein a diameter of said driving gear is larger than a diameter of said first gear.

7. The electric shaving device, as recited in claim 1, wherein said second gear has the same diameter as said driving gear.

8. The electric shaving device, as recited in claim 2, wherein each said second gear has the same diameter as said driving gear.

9. The electric shaving device, as recited in claim 3, wherein said second gear has the same diameter as said driving gear.

10. The electric shaving device, as recited in claim 6, wherein said second gear has the same diameter as said driving gear.

11. The electric shaving device, as recited in claim 1, wherein said power supply comprises a rechargeable battery disposed in said shaving body to electrically connect to said motor.

12. The electric shaving device, as recited in claim 2, wherein said power supply comprises a rechargeable battery disposed in said shaving body to electrically connect to said motor.

13. The electric shaving device, as recited in claim 3, wherein said power supply comprises a rechargeable battery disposed in said shaving body to electrically connect to said motor.

14. The electric shaving device, as recited in claim 6, wherein said power supply comprises a rechargeable battery disposed in said shaving body to electrically connect to said motor.

15. The electric shaving device, as recited in claim 10, wherein said power supply comprises a rechargeable battery disposed in said shaving body to electrically connect to said motor.

16. The electric shaving device, as recited in claim 1, further comprising a blade guider mounted on said shaving head to protect said shaving assembly, wherein said blade guider has a plurality of shaving slots formed thereon to communicate said first and second shaving blades with outside.

17. The electric shaving device, as recited in claim 2, further comprising a blade guider mounted on said shaving head to protect said shaving assembly, wherein said blade guider has a plurality of shaving slots formed thereon to communicate said first and second shaving blades with outside.

18. The electric shaving device, as recited in claim 3, further comprising a blade guider mounted on said shaving head to protect said shaving assembly, wherein said blade guider has a plurality of shaving slots formed thereon to communicate said first and second shaving blades with outside.

19. The electric shaving device, as recited in claim 10, further comprising a blade guider mounted on said shaving head to protect said shaving assembly, wherein said blade guider has a plurality of shaving slots formed thereon to communicate said first and second shaving blades with outside.

20. The electric shaving device, as recited in claim 15, further comprising a blade guider mounted on said shaving head to protect said shaving assembly, wherein said blade guider has a plurality of shaving slots formed thereon to communicate said first and second shaving blades with outside.

* * * * *